United States Patent [19]

Limberg et al.

[11] 4,179,340

[45] Dec. 18, 1979

[54] APPARATUS FOR SUPPLYING PREHEATED COAL CHARGES TO COKING CHAMBERS

[75] Inventors: Jaroslav Limberg; Tomas Limberg, both of Prague; Vaclav Rayman, Milevsko, all of Czechoslovakia

[73] Assignee: Hutni project Praha, projekcni a inzenyrska, Prague, Czechoslovakia

[21] Appl. No.: 776,747

[22] Filed: Mar. 11, 1977

[30] Foreign Application Priority Data

Mar. 26, 1976 [CS] Czechoslovakia ..... 1990/76

[51] Int. Cl.[2] ..... C10B 31/00

[52] U.S. Cl. ..... 202/262; 55/418; 55/461; 406/156

[58] Field of Search ..... 201/40; 202/262, 263; 55/461, 418; 302/59

[56] References Cited

U.S. PATENT DOCUMENTS

| | | | |
|---|---|---|---|
| 3,553,944 | 1/1971 | Hum et al. | 55/461 X |
| 3,753,867 | 8/1973 | Wiemer | 202/262 |
| 3,951,750 | 4/1976 | Drebes | 202/262 |
| 3,953,184 | 4/1976 | Stockford et al | 55/461 X |

FOREIGN PATENT DOCUMENTS

| | | | |
|---|---|---|---|
| 1810324 | 6/1970 | Fed. Rep. of Germany | 202/262 |
| 2020261 | 11/1971 | Fed. Rep. of Germany | 202/262 |
| 411960 | 6/1934 | United Kingdom | 55/461 |

*Primary Examiner*—Arnold Turk

[57] ABSTRACT

Preheated coal charges are pneumatically transported from charging containers by means of a neutral carrier gas to a degassing separator, from which the coal charges, free of the carrier gas, are supplied by gravity to the coking chambers.

4 Claims, 6 Drawing Figures

APPARATUS FOR SUPPLYING PREHEATED COAL CHARGES TO COKING CHAMBERS

BACKGROUND OF THE INVENTION

This invention relates to a method for pneumatically supplying preheated coal charges to coking chambers, and to an apparatus for practicing such method, the apparatus permitting a quick separation of the neutral gaseous carrier medium from the preheated coal charges.

Several methods for supplying preheated coal charges to coking chambers are known; only two of such methods have been employed on an industrial scale.

In the first of such two known industrially-applied methods, preheated coal is fed sequentially from individual containers to the coke ovens by means of a special carriage. A special packing system provided between the containers for hot coal and the carriage, and between the carriage and the coke ovens, provides for the safe and dustless feeding of the preheated coal charge at temperatures up to 160° C., and theoretically permits the use of even higher temperatures. Since this feeding is accomplished entirely by gravity, a highly reproducible bulk density of 833 kg/m$^3$ is achieved. A high accuracy and reliability of charging is necessary with this system, in order to prevent any excessive flow of fine particles into the collecting mains and also to prevent a graphitation of the coke oven.

Another drawback of this apparatus is that the operators of the special carriage must be highly trained; in addition, such operators work in surroundings which are unpleasant and even dangerous, inspite of all safety and hygienic measures which are taken.

The second industrially-applied method of feeding coking chambers with preheated coal charges at a temperature up to 280° C. employs conduits for feeding the coal. When the coke oven is being prepared for the feeding of coal thereinto, a charging container is placed under steam pressure and the preheated coal is supplied to the oven through the feeding conduit in a fluidized state. Individual valves are provided on distributing means associated with the conduit, from which the coal is discharged through lateral openings into the individual coke oven chambers. A gradual filling of the coking chambers is secured by suitable control of the steam pressure which causes the flow of coal in the conduit. Movement of the coal in the conduit and particularly the prevention of its segregation are achieved by the injection of jets of steam into the feeding conduit through nozzles suitably distributed along the active lower part of the conduit. This method is advantageous in that it transports the preheated coal from the charging containers to the coking chambers in a fully safe and dustless manner. A substantial drawback of such method, however, is that a low bulk density is achieved during the filling of the coking chambers with the preheated coal charges, such bulk density being on the order of 660 kg/m$^3$; thus such method entails a lower efficiency of utilization of the space of the coking chambers. Also, in practice there is produced a substantial amount of flue coal dust which is converted to tar; the elimination of such unwanted effects has not yet been satisfactorily accomplished.

SUMMARY OF THE INVENTION

The invention has among its objects the provision of a method of and an apparatus for supplying preheated coal charges to the coking chambers of coke ovens in a safe and dustless manner. The method proceeds smoothly, requires no special operators, and achieves a high bulk density of the coal charge in the coking chambers.

In accordance with the invention the coal charges are transported pneumatically from charging containers by means of a pressurized neutral gaseous carrier medium, for instance nitrogen, above the coking chamber, preferably above its center, the carrier medium being separated from the coal charge in a degassing separator, and the coal charge being further distributed by gravity to one or more chute ducts and directed into the coking chamber.

The method of the invention combines all the advantages of feeding preheated coal by conduits in a fluidized state and the advantages of the filling of the coking chambers by gravity. The method uses a safe method of transporting the preheated coal charges through conduits; the feeding conduit, however, does not terminate at the coking chambers but in degassing separators and thereafter the coal charge slides by gravity into the coking chambers. In the course of this sliding movement residues of the neutral gaseous carrier medium are separated from the coal charge and sucked off into collecting mains.

The pneumatic transportation of the coal charge does not serve to fill the coking chambers, but acts solely to transport the preheated coal charges from the charging containers to points above the centers of the respective coking chambers where the coal then passes into the degassing separator. The preheated coal charge, upon leaving the separator and thus deprived of the neutral gaseous carrier medium, is thereafter conveyed by gravity through long chutes into the coking chambers. The pneumatic coal transporting conduit, the degassing separator, and the vacuum conduit including the chutes are sealingly connected through closure means of the feeding ports to the coking chambers and thus form a closed system, thus securing a safe and dustless feeding of the preheated coal charge. The system for feeding preheated coal charges according to the present invention permits the system to be completely automated, the rate of feeding being controlled so that there is neither a successive generation of gas nor pressure waves in the gas collecting mains.

When a coking chamber is being filled with a preheated coal charge in accordance with the invention, the coking chamber is connected to gas collecting mains, or if such mains are not in operation, to an independent vacuum and cleaning system.

The apparatus of the invention includes one or more charging containers with closing valves, from which the preheated or dried coal charge is conveyed through a pneumatic conduit disposed above the longitudinal axis of the coking battery, the conduit being located at a height of from about 4 to about 12 m above the battery, according to the number of feeding ports connected thereto. The coal passes from the conduit through a coal and gas directing means to the degassing separators. Connected to each of the separators is a vacuum conduit for sucking off the carrier medium by a suction fan, and at least one chute, preferably two chutes, extend from the coal discharging port of the separator to the upper end of the coking chamber.

The degassing separator preferably comprises a suction chamber into which the pneumatic conduit discharges, the suction chamber being curved. Interiorally of the chamber there is a wedge-shaped opening starting at the entrance of the conduit into the suction chamber and gradually widening toward the end of the conduit. In the preferred embodiment of the apparatus, wherein two chutes are employed to discharge the coal by gravity into the coking chamber, a partition wall is provided inside the suction chamber opposite to the end of the conduit, the partition wall dividing the suction chamber into two branches which are connected to respective individual chutes which are symmetrically spaced along the major dimension of the rectangular coking chamber and are located above the center line thereof.

In commercial installations the coal transporting conduit is located at a distance from about 8 to 12 m above the top of the coking battery on a supporting bridge. Generally, two conduits are provided, although there can also be four, each conduit being employed for the filling of from 15–25 coking chambers. Each coal transporting conduit will have, for example, five valves which directly transport the coal to the respective degassing separators, where the preheated coal is separated by centrifugal force from the neutral gaseous carrier medium and is divided and directed to two or more bifurcated chutes terminating at the closures of feeding ports. The coal slides in these bifurcated chutes under the influence of gravity augmented by its speed of travel which remains after its passage through the curved gas separator.

Flaps may be suitably arranged in the chutes to prevent entrance into the coking chambers of any gas taken along by the stream of coal, and also preventing any leakage of fumes from the coking chamber in the direction opposite the direction of flow of coal through the chutes. The feeding port of the chute is arranged so that the flow of the preheated coal charge is as dense as possible and that the turbulence of fine coke particles is reduced to a minimum. The time required to fill one coking chamber by the preheated coal charge can be varied; a time of from 5–7 minutes is generally taken to be the proper time, depending upon the volume of the coking chamber. The bulk density of the preheated coal charge of the customary granulometric composition as conveyed to the coking chamber by the method and apparatus of the present invention is at a minimum equal to the bulk density obtained by the filling of the coking chamber by gravitation, i.e., 833 kg/m$^3$, but in many cases higher bulk densities, i.e., 860 kg/m$^3$ and above are achieved. In the practice of the invention the preheated coal charges may be heated to a temperature of from 160 to 280° C., for example.

As above noted, if a single feeding port is used, it is located at the center of the coking chamber. When a bifurcated degassing separator is used, it is possible to divide each branch of the discharge of the separator still further, thus providing four coal feeding ports.

The degassing separators are connected to a collecting main, by means of which the neutral gaseous carrier medium is sucked off by a suction fan. Removal of coal dust from the neutral gaseous carrier medium is accomplished either in a cleaning unit at the coal preheating station, or in an independent cleaning system which provides for the recirculation and use of the neutral carrier medium.

The charging containers for the preheated coal charges usually have a volume equal to the content of a single coking chamber; the charging containers can be located either above the level of the supply conduit or below the level of the coking chambers. For safety reasons the carrier medium is a neutral gas; nitrogen may advantageously be used in metallurgical coke plants.

BRIEF DESCRIPTION OF THE DRAWING

The invention will be more readily understood upon consideration of the attached drawings showing an exemplary embodiment of the apparatus of the invention. In the drawing.

DESCRIPTION OF PREFERRED EMBODIMENT

Figure 1:
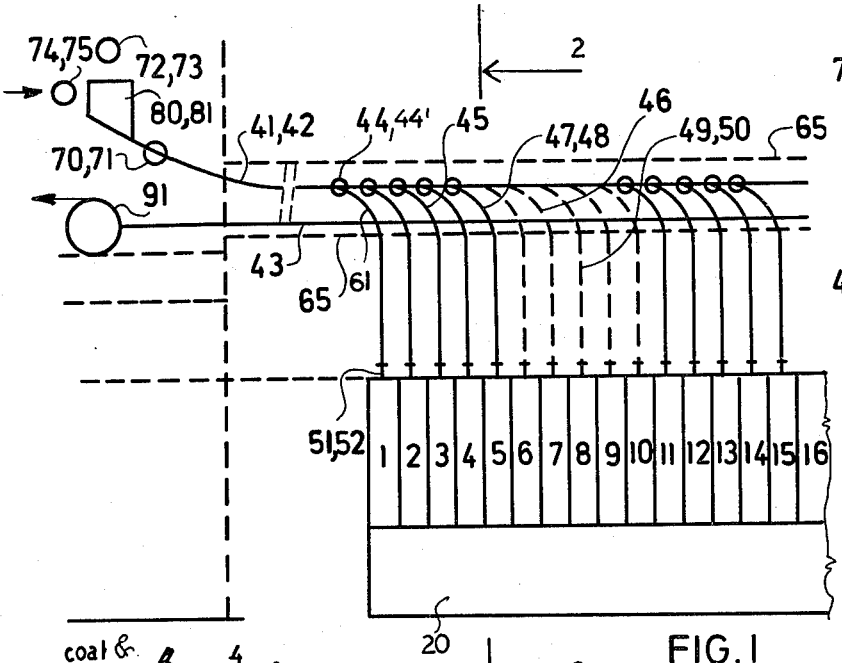
FIG. 1 is a fragmentary schematic view in side elevation of an apparatus for conveying preheated coal charges to coking chambers.

The embodiment of coking oven shown in the drawings and described herein is one having a battery of similar coking chambers 1–16 et seq. which are aligned in side-by-side relationship and disposed upon a regenerator heating means 20. Each of the coking chambers is provided with a heating chamber disposed along each of its two broad sides, that is, at each end of the battery and between the adjacent sides of consecutive coking chambers. For simplicity of illustration, the heating chambers for the coking chambers are not specifically shown in the drawings, including FIG. 1. Each of the coking chambers, in the embodiment shown, is charged with coal at two locations, such locations being disposed midway between the lateral center of the coking chamber and the respective end thereof, as shown in FIG. 2. Two systems for charging coal into the coking chambers are employed, one system charging alternate groups of five coking chambers, and the other system charging the remaining groups of five coking chambers. The coking apparatus employed in the practice of the invention is adapted to receive coal preheated to a temperature of about 160° C. to 280° C. and above.

The coking apparatus is of the by-product type, having collecting mains 59 (FIG. 2) connected to the coking chambers through a suction port 58 in each chamber, or alternatively the collecting main 59 is disconnected and the coking chambers are connected through a suction opening 57 in each to a collecting conduit 54 and to an independent fume-cleaning or scrubbing system (not shown) through a closure means 53.

Figure 2:
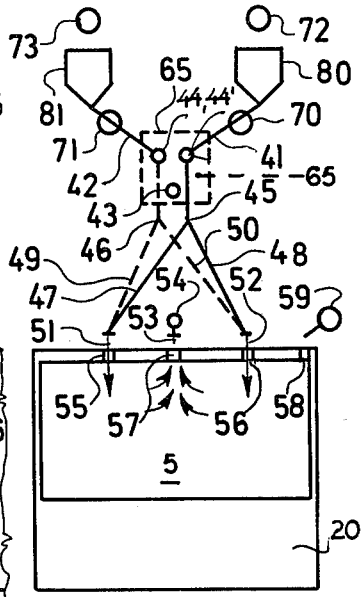
FIG. 2 is a view in vertical section of such apparatus, the section being taken along the line 2—2 in FIG. 1.

Turning to FIG. 2, and particularly the upper part thereof, it will be seen that two coal feeding systems are shown, the system feeding coking chambers 1–5, inclusive, and 11–15, inclusive, in FIG. 1 being shown in full lines to the right, and the system feeding coking chambers 6–10, inclusive, being shown at the left, the lower portion of such latter feeding system being shown in dash lines. Sources of neutral gas under pressure are provided, one such source 74 (FIG. 1) being provided for the right-hand coal feeding system of FIG. 2 and a second source of neutral gas under pressure, designated 75, being provided for the left-hand coal feeding system in FIG. 2. Each system is provided with a selectively closable coal-containing hopper 80, 81, respectively, there being selectively closable valves disposed between the source of neutral gas pressure medium and the hoppers, such valves being designated 72 and 73, respectively. The lower ends of the hoppers 80, 81 are connected to main coal feeding conduits 41 and 42, respectively, through the respective selectively operable valves 70 and 71.

In the right-hand coal feeding system shown in FIG. 2 a degassifier 45, to be further described, is connected to the main conduit 41. Below the degassifier 45 the feeding system divides into two further conduits or branches 48 and 47 which diverge symmetrically from each other and communicate with the feeding ports 56 and 55 of the coking chamber, there designated 5, through selectively operable closure means 52 and 51, respectively. It will be seen that the feeding ports 55 and 56 are disposed laterally symmetrically between the center and the respective ends of the coking chamber. The left-hand feeding system shown in FIG. 2 is similarly constructed, having a degassing means 46 connected to the main conduit 42 thereof and diverging branch conduits 50, 49 communicating with the feeding ports of a coking chamber in the group 6–10, inclusive, for example.

The pneumatic coal transporting conduit 41, 42, the valves 44, 44′ which connect the right and left coal feeding systems (FIG. 2) to the respective conduits 41, 42, the degassing separators 45, 46, and a suction conduit 43 are supported on a supporting structure such as the bridge 65 shown in FIGS. 1 and 2. The height of the coal transporting conduit above the top of the coke oven battery depends upon the structure of the degassing separators 45, 46 and the length and angle of inclination of the individual conduit branches or chutes 47, 48, 49 and 50. The degassing separators 45, 46 are firmly attached to the conduit part of the valves 44, 44′, to the suction conduit 43, and to chutes 47, 48, and 49, 50, as the case may be.

The degassing separators 45 and 46 are similar in construction; consequently, it will suffice to describe the separator 45, which is shown in FIGS. 3–6, inclusive.

Figure 3:
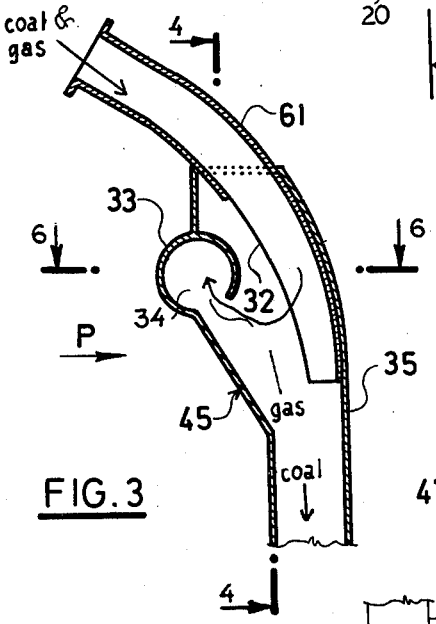
FIG. 3 is a fragmentary view in vertical longitudinal section of a degassing separator.
Figure 4:
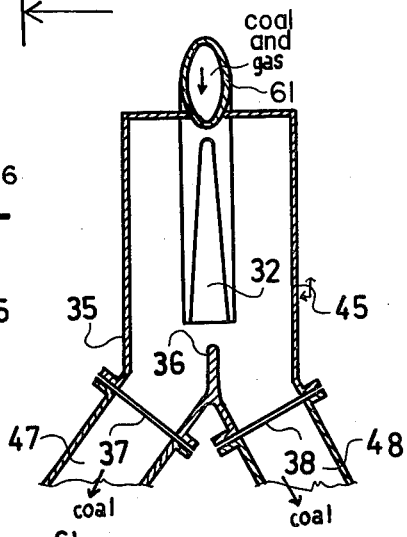
FIG. 4 is a view in vertical transverse section through the degassing separator, the section being taken along the line 4—4 in FIG. 3.
Figure 5:
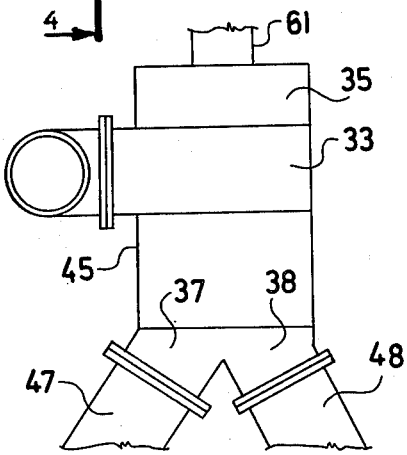
FIG. 5 is a view in side elevation of the degassing-separator, the view being taken in the direction of the arrow P in FIG. 3.
Figure 6:
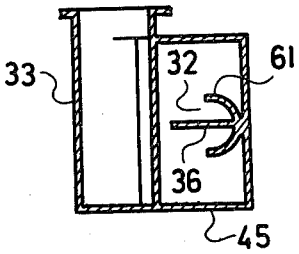
FIG. 6 is a fragmentary view in horizontal section through the degassing separator, the section being taken along the line 6—6 in FIG. 3.

The conduit 61, which is connected to and disposed immediately beneath the valve 44, is bent through an arc of about 60° and is connected to the top of the suction chamber 35 of the degassing separator 45. On the inner side of the bend the conduit 61 within the suction chamber 35 has a wedge-shaped opening 32 in its left-hand wall (FIG. 3). Opening 32 starts at the entrance of the conduit 61 into the chamber 35 and gradually widens in the downward direction toward the lower end of the conduit 61 within the suction chamber 35. A laterally extending pipe 33, which is spaced from and faces the opening 32, is connected to the suction chamber 35 for connecting the degassing separator 45 with the suction conduit 43, the pipe 33 being provided with a downwardly open suction port 34 inside the suction chamber 35.

A partition wall 36 is provided in the lower part of the suction chamber 35 on the vertical center line of the lower end of the conduit 61 and of the opening 32 in its wall, the partition 36 dividing the lower part of the suction chamber 35 into two branches 37 and 38 to which chutes 47 and 48 are connected.

The preheated coal charge, together with the neutral gaseous carrier medium, enter at full transport speed into the conduit part 61 of the degassing separator 45. Due to the centrifugal forces generated by the forced change of direction of flow of the preheated coal charge along the arcuate part of the conduit 61 the coal charge is forced to the right (FIG. 3) against the right-hand wall of conduit 61, whereas the gaseous neutral carrier medium remains near the internal part of conduit 61 and escapes therefrom by way of the wedge-shaped opening 32 into the widened part of the degassing chamber 35. From such widened part of the degassing chamber the gas travels through the suction port 34 in the pipe 33 and is sucked off into the suction pipe 43 and the cleaning device or devices. The preheated coal charge at the lower end of the bent part of conduit 31, which has now been freed from the gaseous neutral carrier medium, is thrown against the top of the partition wall 36 and is divided into halves by the lower conduit branches 37 and 38 of the degassing separator 45. The preheated coal charge slides along the branches 47 and 48 through the opened closure means for the charging ports of the chamber and thence into the coking chamber.

The filling of the coking chambers by preheated coal charges in accordance with the method of the present invention proceeds as follows: The closures 51 and 52 of feeding ports 55 and 56 are opened and the suction conduit 43 is connected to the suction fan 91. The valves 44, 44′ are open to positions for filling the coking chambers. The charging containers or hoppers 80 and 81 are placed under pressure of the neutral gaseous coal transporting medium by the devices 74, 75 with valves 70, 71 and 72, 73 closed so that the preheated coal charges in the hoppers 80, 81 are prepared for pneumatic transport. After the valves 70, 71 have been opened, the preheated coal charge flows together with the neutral gaseous carrier medium in the conduits 41, 42 through the respective valves 44, 44′ to the degassing separators 45, 46.

Due to centrifugal forces the neutral carrier medium is released in the widened space of the degassing separators 45, 46 and is sucked off via the conduit 43. The preheated coal charge released from the gases proceeds further due to inertia and is divided into halves, in the case of the righthand feeding system of FIG. 2 one-half being forwarded to chute 48 and the other half being forwarded to chute 49. Any residue of the neutral gaseous carrier medium is separated in the chute and sucked off opposite the direction of flow of the coal into the collecting conduit 43. The preheated coal charge slides in the chutes 47, 48 and 49, 50 through closure means 51, 52 through feeding ports 55, 56 into the coking chamber. After the complete emptying of the charging containers 80, 81 and the filling of the coking chambers by the preheated coal charge, the devices 74, 75 supplying the neutral gaseous medium are cut off, the valves 70, 71 are closed, the valves 44, 44′ are placed in the positions thereof opening the conduits 41, 42, and the closures 51, 52 for the feeding ports 55 and 56 are closed. The suction conduit 43 is then disconnected. In case the coking chambers, during the course of their being filled with coal, are connected to an independent sucking and fume-cleaning device 57, 53, 54, such cleaning device is disconnected from the coking chambers by the closures 53 at the completion of the filling of the coking chambers, and the collecting main or mains 59 are then joined to the ports 58 of the coking chambers.

Although the invention is illustrated and described with reference to a single preferred embodiment thereof, it is to be expressly understood that it is in no way limited to the disclosure of such a preferred embodiment, but is capable of numerous modifications within the scope of the appended claims.

What is claimed is:

1. Arrangement for supplying preheated coal particles to a battery of coking ovens, comprising pneumatic charging containers for preheated coal particles, means for closing the charging containers, means for supplying a pressurized inert carrier gas to said containers, a pneumatic transport conduit for conveying a mixture of the preheated coal particles and the carrier gas connected to said containers and extending substantially above the longitudinal axis of the coking ovens forming the coking battery and adapted for feeding the coking ovens with coal, at least two spaced charging ports at the top of each coking oven, a degassing separator disposed above each coking oven and below said pneumatic transport conduit, conduit means including valve means for connecting the degassing separators to the pneumatic transport conduit, each degassing separator having an inlet for the mixture of coal particles and inert carrier gas, an outlet for the carrier gas, and an outlet for the separated coal particles, means to divide the separated coal charge into at least two streams, and conduit means for receiving the respective streams of coal particles connected to the respective charging ports of the respective coking ovens.

2. Arrangement as claimed in claim 1, wherein each degassing separator comprises a generally vertically disposed suction chamber, and the conduit means connecting each of the degassing separators to the pneumatic transport conduit comprises an arcuately downwardly bent supply conduit for the mixture of coal particles and inert carrier gas, said supply conduit having its lower end portion pointing downwardly, passing into the top of the suction chamber, and terminating at its bottom therewithin, the outer wall of said lower end portion of the arcuately bent supply conduit, which has the largest radius of bend, being disposed close to a wall of the suction chamber, the opposite, inner wall of said lower end portion of the arcuately bent supply conduit, which has the smallest radius of bend, facing the interior of the suction chamber and being provided with an opening therein in the shape of a wedge which starts at the top at the inlet of the arcuately bent supply conduit within the suction chamber and widens in a downward direction toward the bottom of the lower end portion of the supply conduit, and means for sucking the inlet carrier gas from the suction chamber.

3. Arrangement as claimed in claim 2, wherein the means to divide the separated coal charge into at least two streams comprises vertically disposed partition means in the suction chamber disposed symmetrically below the wedge-shaped opening in the lower end of the supply conduit.

4. Arrangement as claimed in claim 3, wherein the means for sucking the inlet carrier gas from the suction chamber comprises a laterally extending suction pipe within the suction chamber spaced from and facing the wedge-shaped opening in the lower end of the supply conduit, said suction pipe having a downwardly open suction port therein.

* * * * *